US005188361A

United States Patent [19]

Coombe

[11] Patent Number: 5,188,361

[45] Date of Patent: Feb. 23, 1993

[54] PIVOTING GOLF PUTTER APPARATUS

[76] Inventor: Douglas C. Coombe, 3464 S. River Ter., Edgewater, Md. 21037

[21] Appl. No.: 806,202

[22] Filed: Dec. 13, 1991

[51] Int. Cl.[5] ..... A63B 53/02; A63B 53/08

[52] U.S. Cl. ..... 273/81.3; 273/193 B; 273/80.1

[58] Field of Search ..... 273/81 R, 81 C, 81.2, 273/81.3, 80.1, 735, 193 B

[56] References Cited

U.S. PATENT DOCUMENTS

| | | | |
|---|---|---|---|
| 1,557,156 | 10/1925 | Gless | 273/81.2 |
| 1,561,349 | 11/1925 | Murphy et al. | 273/81.3 |
| 1,616,377 | 2/1927 | Knight | 273/81.3 |
| 2,593,822 | 4/1952 | Wendt et al. | 273/193 B |
| 3,033,575 | 5/1962 | Hause | 273/193 B |
| 3,102,726 | 9/1963 | Barrett | 273/81.2 |
| 3,170,690 | 2/1965 | Goranson et al. | 273/81.3 |
| 4,367,871 | 1/1983 | Schiefer | 273/73 J |

FOREIGN PATENT DOCUMENTS

| | | | |
|---|---|---|---|
| 0026154 | of 1902 | United Kingdom | 273/81.3 |

*Primary Examiner*—V. Millin
*Assistant Examiner*—Steven B. Wong
*Attorney, Agent, or Firm*—Leon Gilden

[57] ABSTRACT

A golf putter includes an extension handle formed with a lower distal end pivotally receiving an upper distal end of an associated golf putter therewithin to permit a pendulum motion of the golf putter for use in a golf swing. Modifications of the invention include the use of complex pivoting motion relative to the golf putter for advanced play.

1 Claim, 4 Drawing Sheets

PIVOTING GOLF PUTTER APPARATUS

BACKGROUND OF THE INVENTION

1. Field of the Invention

The field of invention relates to golf club apparatus, and more particularly pertains to a new and improved pivoting golf putter apparatus wherein the same is arranged to permit a pendulum motion of the associated golf putter and head.

2. Description of the Prior Art

Golf putters of various types have been utilized in the prior art to enhance a golf swing in the placement of a golf ball within a target cup. Such prior art structure is exemplified in the U.S. Pat. No. 3,874,668 to Felge setting forth a pendulum type golf putter utilizing a generally serpentine putter head arranged to accommodate a gripping thereof by an individual and the positioning of an individual's forearm to align the golf putter with the individual's arm.

U.S. Pat. No. 3,663,019 to Palotsee sets forth an adjustable golf putter utilizing various swivel and telescoping connections.

U.S. Pat. No. 4,815,740 to Williams, et al. sets forth an adjustable golf club head permitting relative pivotment of the golf putter head relative to the golf putter shank.

As such, it may be appreciated that there continues to be a need for a new and improved pivoting golf putter apparatus as set forth by the instant invention which addresses both the problems of ease of use as well as effectiveness in construction permitting a pendulum motion of an associated golf club and in this respect, the present invention substantially fulfills this need.

SUMMARY OF THE INVENTION

In view of the foregoing disadvantages inherent in the known types of golf putter apparatus now present in the prior art, the present invention provides a pivoting golf putter apparatus wherein the same provides for a pivoted mounting of an upper distal end of a golf club shaft. As such, the general purpose of the present invention, which will be described subsequently in greater detail, is to provide a new and improved pivoting golf putter apparatus which has all the advantages of the prior art golf putter apparatus and none of the disadvantages.

To attain this, the present invention provides a golf putter including an extension handle formed with a lower distal end pivotally receiving an upper distal end of an associated golf putter therewithin to permit a pendulum motion of the golf putter for use in a golf swing. Modifications of the invention include the use of complex pivoting motion relative to the golf putter for advanced play.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved pivoting golf putter apparatus which has all the advantages of the prior art golf putter apparatus and none of the disadvantages.

It is another object of the present invention to provide a new and improved pivoting golf putter apparatus which may be easily and efficiently manufactured and marketed.

It is a further object of the present invention to provide a new and improved pivoting golf putter apparatus which is of a durable and reliable construction.

An even further object of the present invention is to provide a new and improved pivoting golf putter apparatus which is susceptible of a low cost of manufacture with regard to both materials and labor, and which accordingly is then susceptible of low prices of sale to the consuming public, thereby making such pivoting golf putter apparatus economically available to the buying public.

Still yet another object of the present invention is to provide a new and improved pivoting golf putter apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
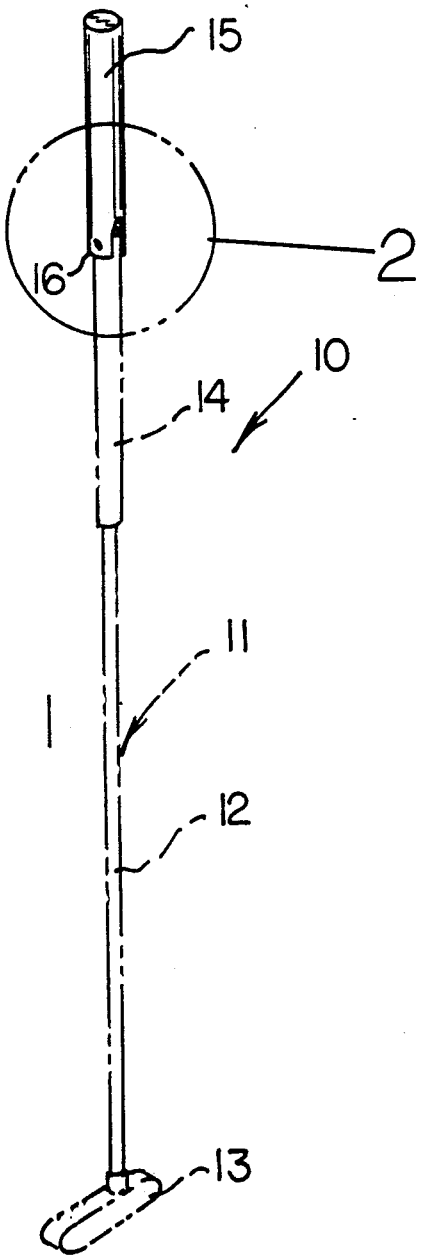
FIG. 1 is an isometric illustration of the invention in use.
Figure 2:
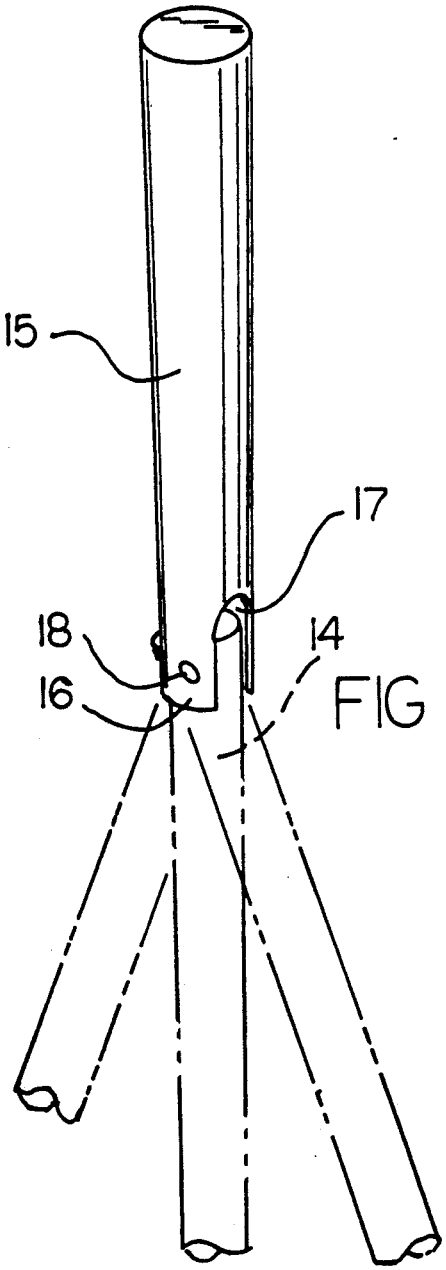
FIG. 2 is an enlarged isometric illustration of section 2 as set forth in FIG. 1.

With reference now to the drawings, and in particular to FIGS. 1 to 9 thereof, a new and improved pivoting golf putter apparatus embodying the principles and concepts of the present invention and generally designated by the reference numeral 10 will be described.

More specifically, the pivoting golf putter apparatus 10 of the instant invention essentially comprises in combination with a golf putter 11 formed with a putter shank 12 integrally mounting a putter head 13 at its lower distal end. A handle 14 is mounted coaxially about the shank 12 about an upper portion of the shank. A support handle 15 is provided and formed with a handle bifurcated lower distal end 16 defining a handle slot 17 directed into the lower distal end of the handle. An axle 18 is orthogonally directed through and medially of the slot 17 to pivotally mount the upper distal end of the handle 14 therewithin. In this manner, the golf putter 11 may be pivoted about the support axle 18 to permit a pendulum-like motion of the shank 12 and the associated putter head 13 in use of impact with an associated golf ball (not shown).

Figure 3:
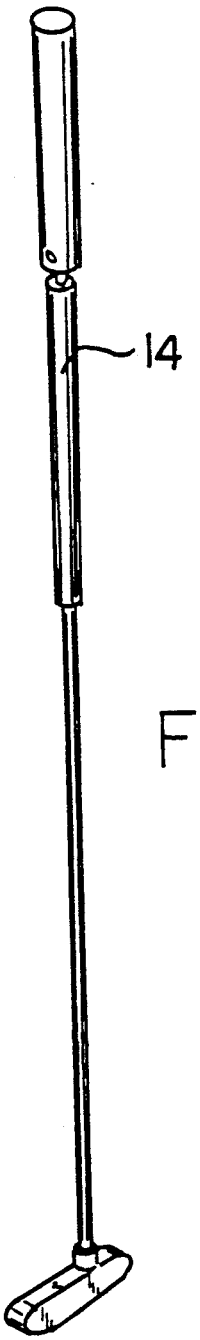
FIG. 3 is an isometric illustration of a modified extension shaft for use with the associated golf putter.
Figure 4:
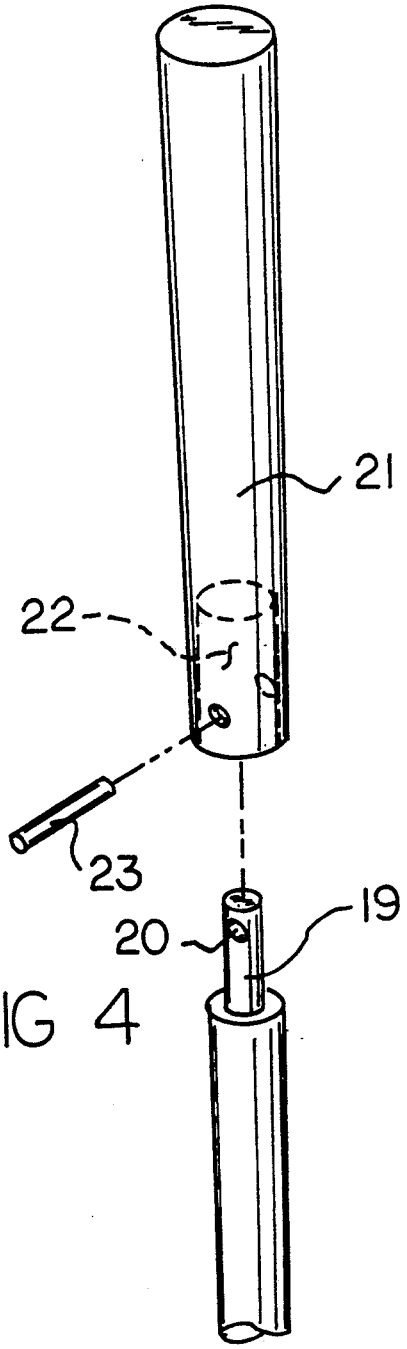
FIG. 4 is an exploded isometric illustration of the connection as set forth in FIG. 3.
Figure 5:
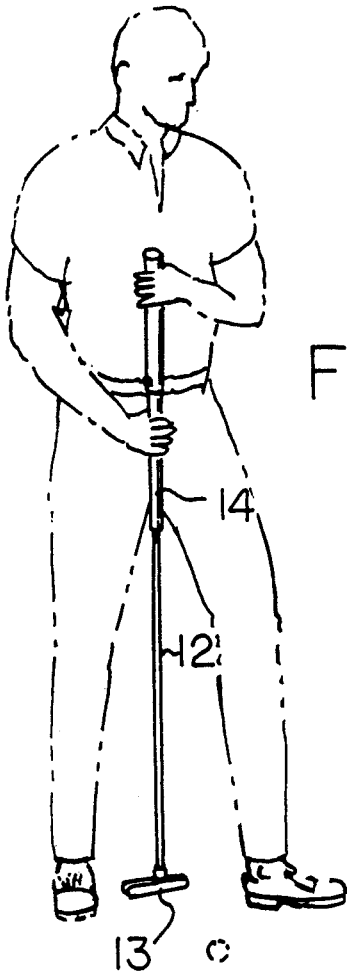
FIG. 5 is an isometric illustration of the golf club of FIG. 3 in use.
Figure 6:
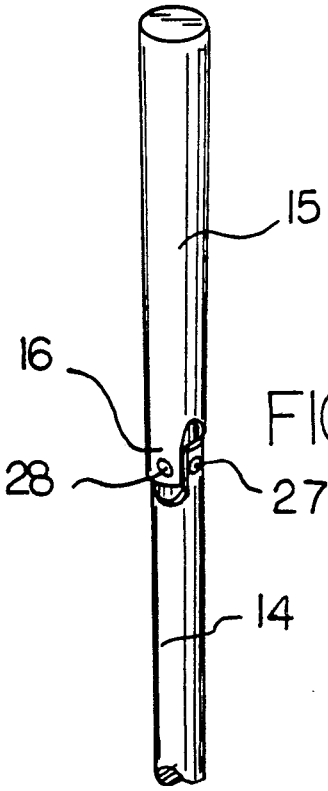
FIG. 6 is an isometric illustration of a modified golf putter connection utilizing a universal joint.
Figure 7:
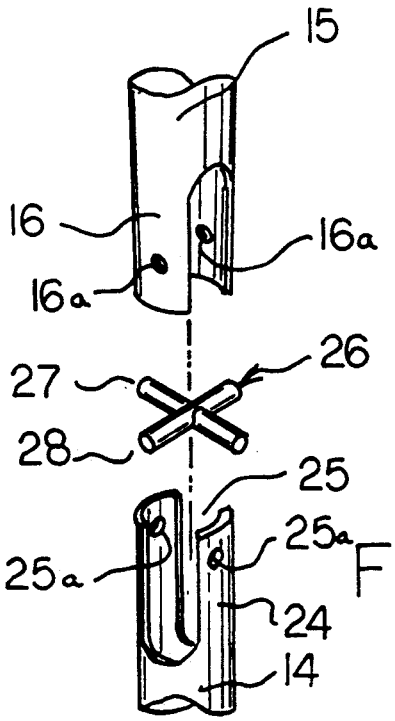
FIG. 7 is an exploded isometric illustration of the connection as set forth in FIG. 6.

The FIGS. 3-5 illustrate the use of a modified putter 11, wherein the handle 14 includes an extension shaft 19 coaxially oriented relative to the handle 14 extending upwardly thereof. An extension shaft bore 20 is provided and may be received within the slot 17, or alternatively within a further support handle 21 that is formed with a handle socket 22, wherein a securement pin 23 receives the extension shaft 19, wherein the pin 23 is directed into the socket 22 and through the bore 20 to provide for an elongate handle affording leverage in a putting situation, as illustrated in FIG. 5.

A modified pivotment of the handle includes the handle 14 formed with a handle bifurcated upper distal end 24 defining a putter handle slot 25. In this manner, a crossed pin 26 forms a universal joint connection by utilizing a first pin leg 27 orthogonally oriented relative to the second pin leg 28, wherein the first pin leg 27 is directed through coaxially aligned and spaced putter handle bores 25*a* and wherein the second pin leg 28 is received through the bifurcated lower distal end 16 and the lower distal end bores 16*a* that are also arranged in a coaxially aligned relationship.

Figure 8:
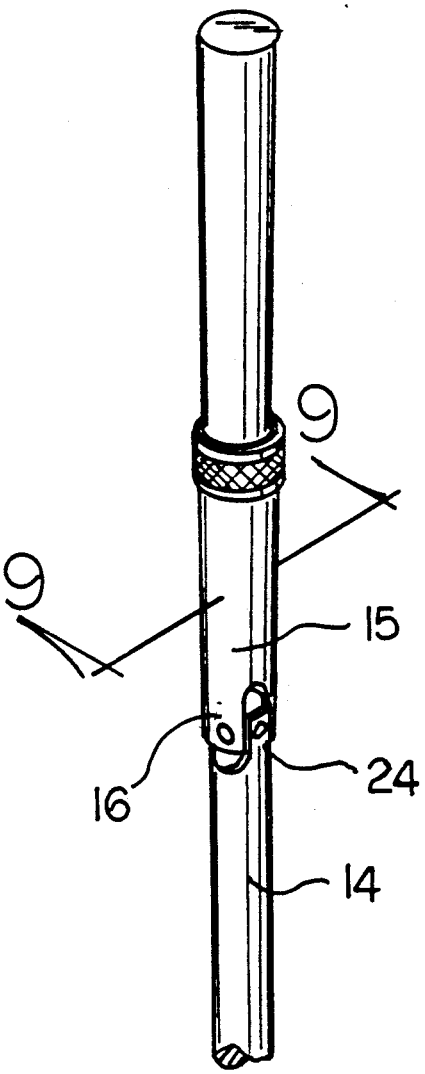
FIG. 8 is an isometric illustration of a further modified extension handle utilized by the invention.
Figure 9:
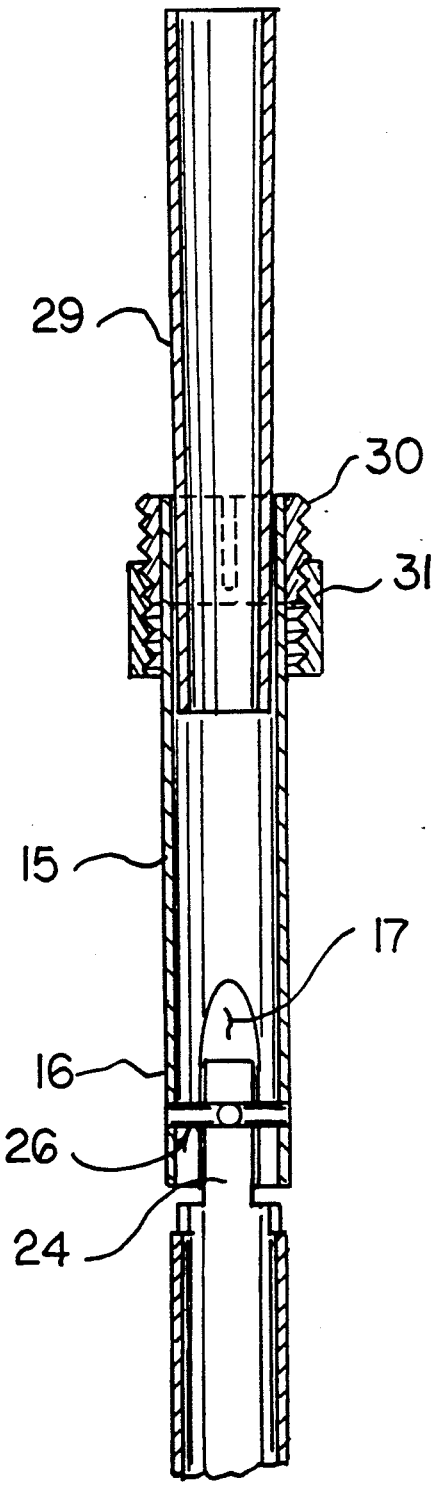
FIG. 9 is an orthographic view, taken along the lines 9—9 of FIG. 8 in the direction indicated by the arrows.

FIGS. 8 and 9 illustrate the invention, and more specifically the handle 15, including an extension tube 29 telescopingly mounted within the handle 15, wherein an externally threaded conical collar 30 is mounted about an upper distal end of the support handle 15 cooperating with an internally threaded lock ring 31, whereupon extension of the extension tube 29 relative to the collar 30 and subsequent tightening of the lock ring about the collar effects selective locking of the extension tube relative to the handle 15 for extended leverage.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pivoting golf putter apparatus, comprising, a golf putter, the golf putter including a golf putter shank, the golf putter shank including a head mounted at a lower distal end thereof, and a handle formed about an upper portion of the golf putter shank, and further including a support handle, the support handle including a bifurcated lower distal end, the bifurcated lower distal end includes coaxially aligned lower distal end bores formed on opposed sides of a handle slot defined by the bifurcated lower distal end, and an axle medially directed through the slot and the lower distal end bores, and the putter handle including at least one putter handle bore received within the support handle slot, with the axle directed through the at least one putter handle bore and the lower distal end bores to pivotally secure the upper distal end of the putter handle within the support handle slot, and the putter handle upper distal end includes a bifurcated upper distal end, and the bifurcated upper distal end defines a putter handle slot, and the axle includes a first pin leg orthogonally oriented relative to a second pin leg, wherein the first pin leg and the second pin leg are integrally mounted relative to one another, and the second pin leg is directed through the lower distal end bores, and the bifurcated upper distal end defines a putter handle slot, the putter handle slot defining an additional putter handle bore in cooperation with the at least one putter handle bore to receive the first pin leg therethrough, and the support handle includes an externally threaded conical collar mounted about an upper portion of the support handle, and an extension tube telescopingly mounted within the support handle, and an internally threaded lock ring mounted about the conical collar, wherein tightening of the lock ring about the conical collar effects securement of the extension tube in a predetermined orientation relative to the support handle.

* * * * *